United States Patent [19]

Tucci

[11] 3,935,628

[45] Feb. 3, 1976

[54] APPARATUS FOR INSERTING WIRES INTO TERMINALS IN AN ELECTRICAL CONNECTOR

[75] Inventor: John James Tucci, Winston-Salem, N.C.

[73] Assignee: AMP Incorporated, Harrisburg, Pa.

[22] Filed: Nov. 29, 1974

[21] Appl. No.: 528,524

[52] U.S. Cl.... 29/203 DT; 29/203 HT; 29/203 MW; 29/206 D; 29/628

[51] Int. Cl.[2]..... H01R 43/04

[58] Field of Search... 29/203 MW, 203 H, 203 HT, 29/203 HC, 203 J, 203 P, 203 DT, 206, 628

[56] References Cited

UNITED STATES PATENTS

| | | | |
|---|---|---|---|
| 3,758,935 | 9/1973 | Long et al. | 29/203 MW |
| 3,800,390 | 4/1974 | Johnston | 29/203 MW |
| 3,816,897 | 6/1974 | Long | 29/203 MW |
| 3,864,802 | 2/1975 | Tucci | 29/203 MW |

*Primary Examiner*—Carl E. Hall
*Attorney, Agent, or Firm*—Frederick W. Raring; Robert W. Pitts; Jay L. Seitchik

[57] ABSTRACT

Apparatus for inserting wires into terminals in an electrical connector having the terminals arranged in two parallel rows comprises a support plate having spaced apart side-by-side wire jig means thereon and having a connector jig means pivotally mounted between the wire jig means. Each wire jig means locates a plurality of wires in side-by-side parallel relationship with the wires spaced apart by distances which correspond to the spacing of the terminals in the connector. Each wire jig means has associated therewith inserting means so that wires in the jig means are inserted into terminals in one of the rows when the connector jig is swung against the wire jig.

3 Claims, 7 Drawing Figures

APPARATUS FOR INSERTING WIRES INTO TERMINALS IN AN ELECTRICAL CONNECTOR

BACKGROUND OF THE INVENTION

This invention relates to apparatus for inserting wires into electrical contact terminals which are contained in a connector, the connector being of the general type shown in U.S. Pat. No. 3,760,335. Other inserting apparatus for inserting wires into terminals in connectors are shown in U.S. Pat. Nos. 3,758,935, 3,800,390, and 3,816,897.

Electrical connectors of the type disclosed and claimed in U.S. Pat. No. 3,760,335 have received widespread acceptance, particularly in the telephone industry, and they are now being used in large numbers. Several types of insertion tools are available, the tool shown in U.S. Pat. No. 3,758,935 being widely used. Because of the widespread use of pre-loaded connectors of the type referred to above, a variety of types of tools are needed for different circumstances and the instant invention is directed to the achievement of a tool of relatively simplified construction which has many of the desirably features of previously known tools and which is ideally suited for certain circumstances.

It is accordingly an object of the invention to provide an improved apparatus for inserting wires into terminals in a multi-contact electrical connector. A further object is to provide a tool which can be produced at low cost and which requires a minimum of operator training when it is put to use. A further object is to provide a compact and rugged tool which will withstand ordinary, or even abusive, treatment when used by a technician at the site of a wiring operation.

These and other objects of the invention are achieved in a preferred embodiment thereof which is briefly described in the foregoing abstract, which is described in detail below and which is shown in the accompanying drawing in which:

FIG. 1 is a perspective view, with parts cut away, of a preferred embodiment of a tool in accordance with the invention.

Figure 7:
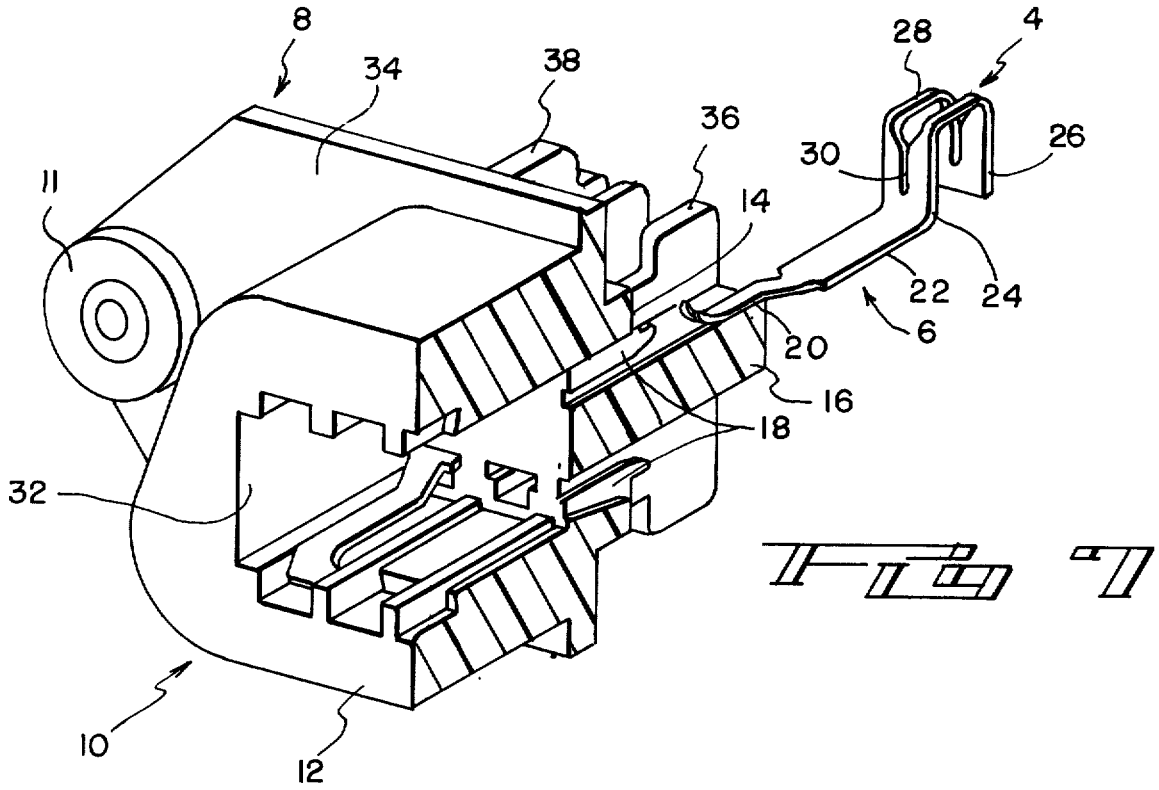

FIG. 7 is a fragmentary perspective view of one form of electrical connector of the type shown in U.S. Pat. No. 3,760,335.

The embodiment of the invention disclosed herein is specifically intended for inserting wires into a connector of the general type shown in FIG. 7 and disclosed more fully in the above-identified U.S. Pat. No. 3,760,335. An understanding of some of the structural features of this connector will facilitate an understanding of the instant invention and the connector shown in FIG. 7 is, therefore, briefly described below.

In accordance with the teachings of U.S. Pat. No. 3,760,335 wires 2 are connected to the wire receiving portions 4 of electrical contact terminals 6 which are contained in the housing 10 of the connector 8. The housing has a mating face 12 and a rearward face 14. A central rib 16 extends from the rearward side or face and a plurality of side-by-side contact receiving cavities 18 extend through the housing on the upper and lower sides of the rib. Each cavity contains an individual terminal 6 and each terminal has a forward contact portion 20, an intermediate shank 22, and the previously identified wire receiving portion 4 which comprises two plate-like members 24, 26 which are connected at their upper ends by strap sections 28. The wire 2 is moved laterally of its axis into the gap between the strap members 28 and into slots 30 in the plate sections, the width of these slots being such that the insulation of the wire is penetrated and electrical contact is established with the conducting core. When the terminals are mounted in the cavities, the contact portions extend forwardly and into a trough-like recess 32 in the mating face 12 which is adapted to receive a complementary male connector.

Adjacent terminals in the two rows are separated from each other by barriers 36 and the end barriers 38 extend somewhat beyond the other barriers 36 as shown. The housing 10 is provided with a radially extending flange 34 by means of which it may be mounted in a panel or the like.

Figure 11:
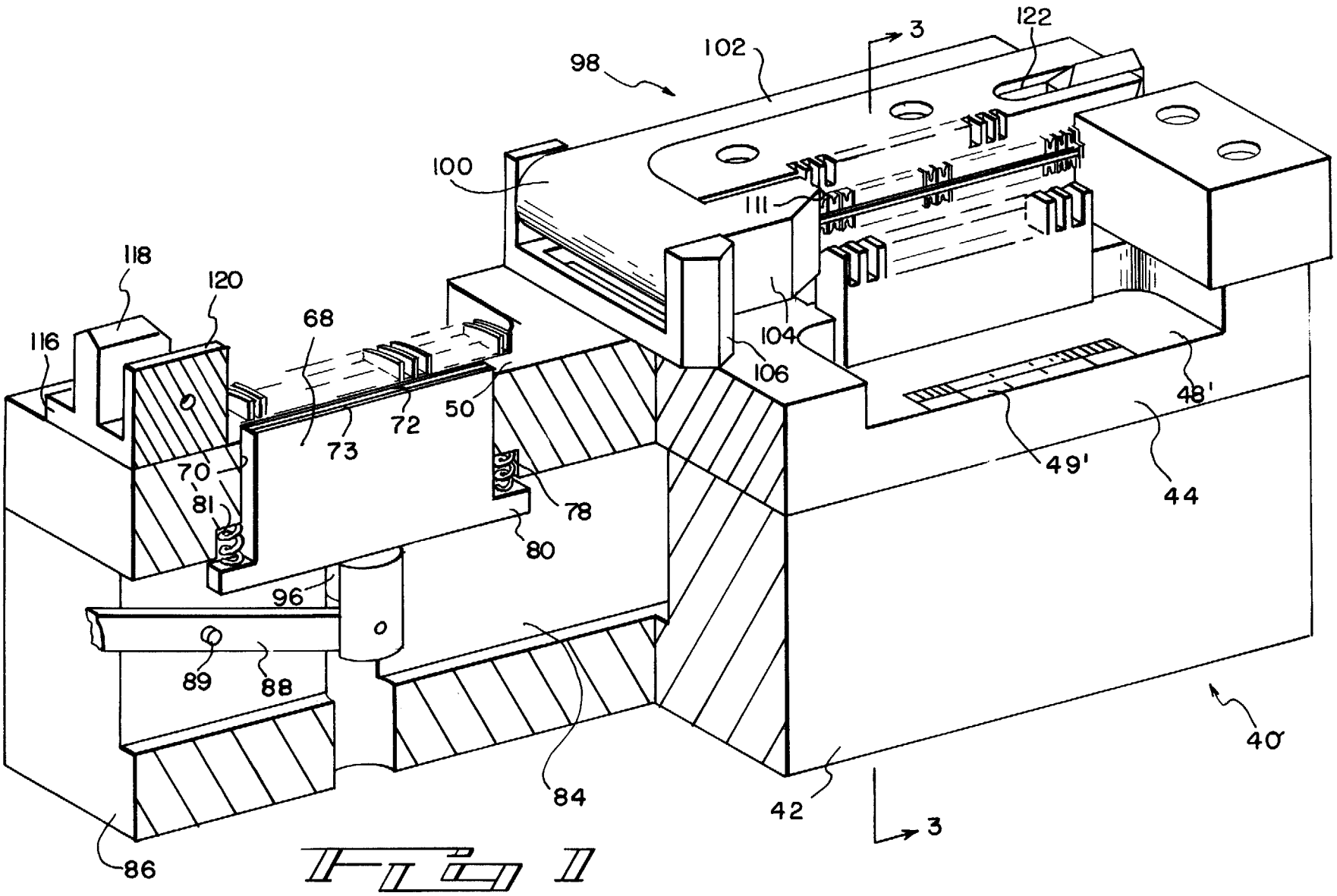
Figure 2:
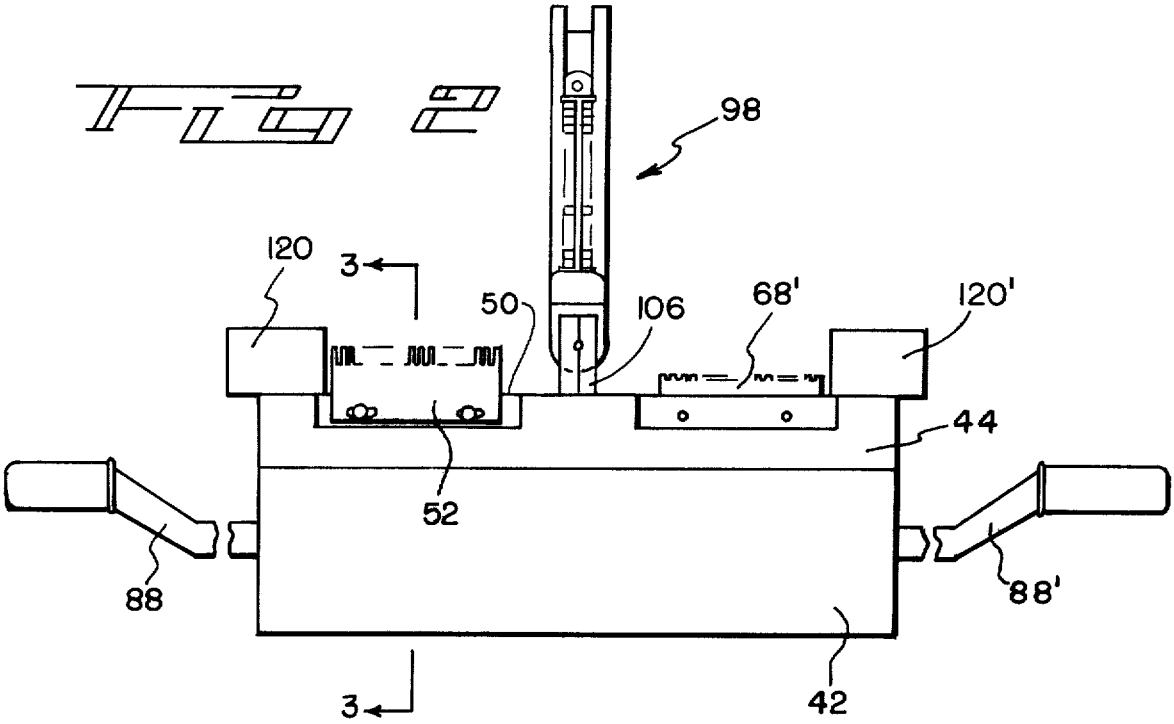
FIG. 2 is a frontal view of the tool with the connector jig in its vertical position.
Figure 6:
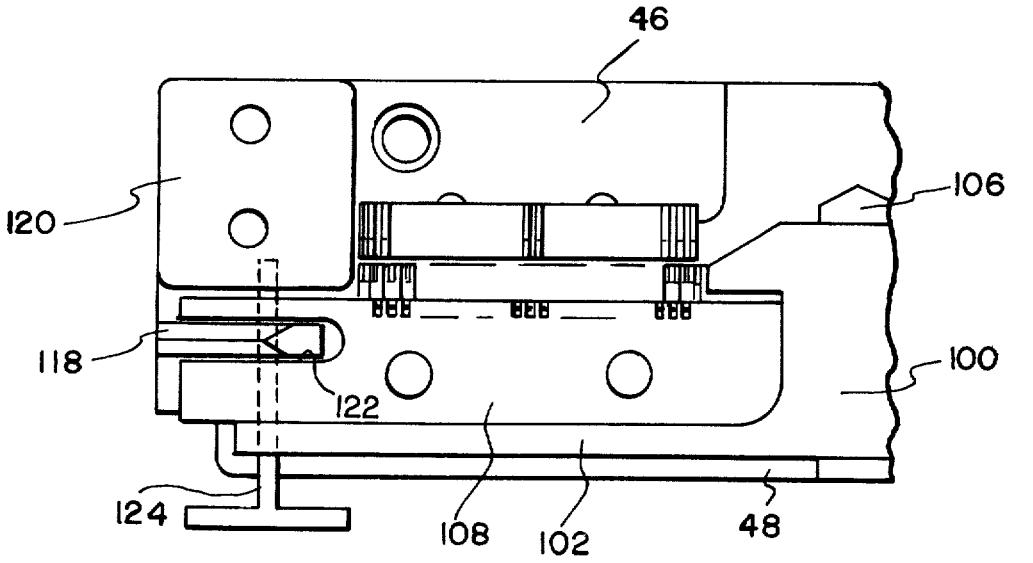
FIG. 6 is a top plan view of the lefthand side of the tool.

Referring now to FIGS. 1, 2 and 6, the disclosed embodiment comprises an apparatus 40 having a base block 42 on the upper surface of which a support plate or platen 44 is mounted. Platen 40 has two spaced-apart wire jig means, one on the right and one on the left as viewed in FIGS. 1 and 2, and a connector jig means which is pivotally mounted betweeen the wire jig means. Since the wire jig means are substantially identical, a description of one will suffice for both. Accordingly, only the wire jig means on the left as viewed in FIG. 1 will be described in detail in the same reference numerals, differentiated by prime marks, will be used for both of the jig means.

Figure 3:
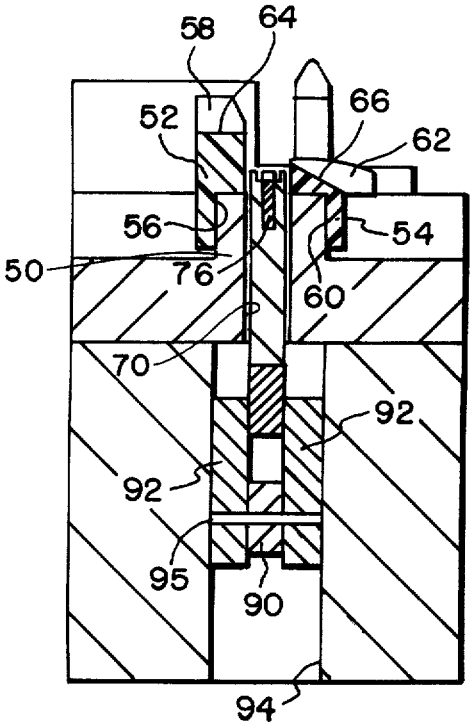
FIG. 3 is a view taken along the lines 3—3 of FIG. 2.

Recesses 46, 48 are provided on the plate 44 and extend inwardly from the front and rear sides of the plate, these recesses being separated by a rib 50 in which a wire inserter is mounted as will be explained below. The wires are located in side-by-side parallel relationship by wire locating means 52, 54, FIG. 3, which are commonly referred to as combs. The comb 52 comprises a block of plastic material which is cut away on its lower side at 56 so that it fits snugly against and on the left-hand side portion of the rib 50 as viewed in FIG. 3. Spaced-apart barriers 58 extend upwardly from the upper surface of the comb, the spacing between the barriers being the same as the spacing between adjacent terminals in the connector. The comb 54 similarly comprises a block of insulating material which is cut away or recessed at 60 so that it fits snugly against the right-hand side of the rib 50. This comb has spaced-apart barriers 62 which extend upwardly and rightwardly, cantilever fashion, from the rib 50 to maintain the wires separated from each other. It will be noted that the wire supporting surfaces 64 of the comb 52 are somewhat elevated with respect to the corresponding surfaces 66 of comb 54 and that the surfaces 66 slope downwardly and to the right as viewed in FIG. 3 for reasons which will become apparent as this description proceeds. The combs are preferably of molded plastic material and are secured to the rib by suitable fasteners as shown.

The individual wires are trimmed and inserted into the terminals by a wire trimming and inserting means comprising a plate 68 disposed in a rectangular slot 70 which extends downwardly through the upper surface of the rib 50. The upper end of plate 68 has spaced-apart parallel flanges 72, 74 and spaced-apart insertion punches 76 are mounted in the plate between these flanges. Each punch inserts one of the wires into a terminal as will be described below and the wires are trimmed by the cooperative action of one edge 73 of flange 74 and a cutting edge 114 or a shear plate 110.

Plate 68 has laterally extending portions 80 on its lower end and springs 82, which are disposed in recesses 78 on each side of the slot 70, bear against the portions 80 and the upper walls 81 of the recesses thereby to bias the plate downwardly but to permit its upward movement during insertion.

The plate is moved upwardly by a handle 88 which extends into a recess or slot 84 extending into the side 86 of the base 42. Handle 88 is pivoted at 89 to the base 42 and has an end portion 90 which extends between slide members 92 which are slidably contained in a vertical bore 94 in the base 42. The end of the handle is pivoted at 95 to the slide members so that when the handle is moved downwardly from the position shown in FIG. 1, the slides 92 will move upwardly. The upper surface of these slides bears against the lower edge of the plate 68 and a downwardly projecting ear 96 on the plate 68 is received between the slide members.

Figure 5:
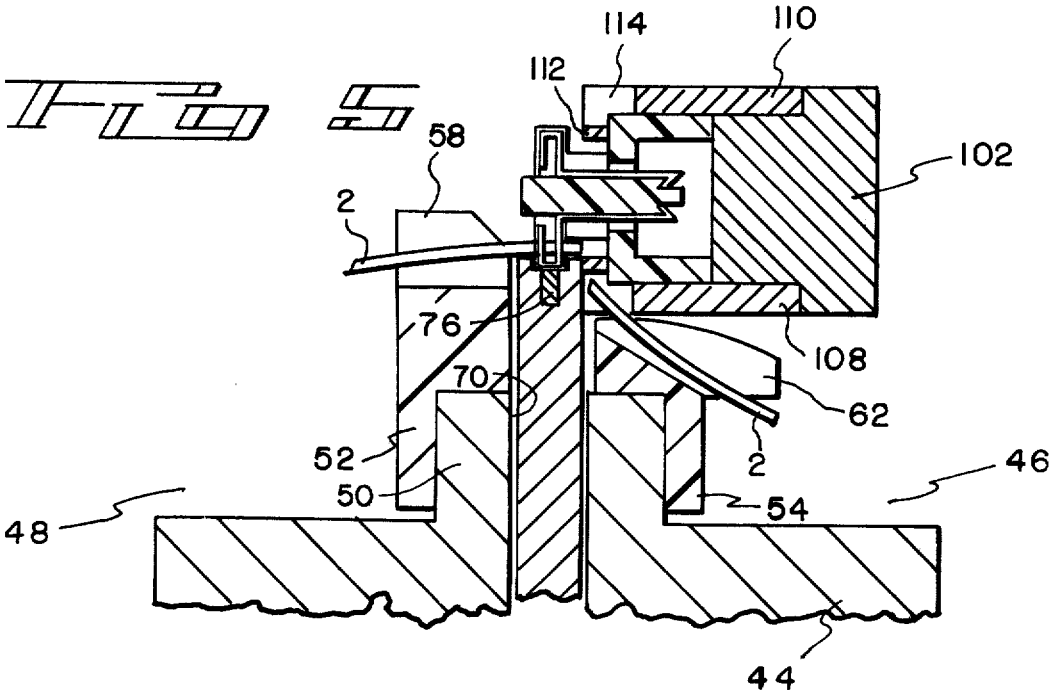
FIG. 5 is a view similar to FIG. 4 but showing the positions of the parts after insertion of the wires.

The previously identifying connector jig 98 is generally L-shaped having a base portion 100, a longer arm 102, and a relatively shorter arm 104. The base portion is pivotally mounted on a bracket 106 on the upper surface of the platen 44 so that it can be swung through an angle of 180° to position it adjacent to either of the wire jigs. Wire shear plates 108, 110 are secured by suitable fasteners against the opposite sides of the arm 102 and these shear plates have flanges 112 which extend towards each other. The flanges are notched at spaced-apart intervals to provide shearing edges 114 for cooperation with previously identified shearing edge 73. As shown in FIG. 5, the dimensions of the arm 102 are such that the connector will fit snugly between the plates 108, 110 and the flanges 112 will bear against the rearwardly facing surfaces of the connector housing. It will also be apparent that one side of rib 16 of the connector is located against the surface 111 of the arm 104 so that the notches in the shear plates will be in alignment with the terminals in the connector and with the wires.

It is desirable to provide a means for accurately positioning the free end of the connector jig adjacent to each of the wire jigs, such positioning means being provided in the form of a locating bracket 116 which is secured to the upper surface of the platen 44 which has spaced-apart ears 118, 120. The plates 108, 110 are notched at 122 to receive the ear 118 as shown in FIG. 1. It is also desirable to provide aligned openings in the connector jig and in the ears 118, 120 so that a locking pin 124 can be inserted through these openings to hold the connector jig in either of its selective positions.

It is desirable to provide indicia 49 on one or both of the surfaces of the recesses 46, 48, this indicia being in the form of color coding arranged to correspond to the color coding conventions used on standard types of cables which are employed in the telephone industry. If these indicia are provided, the operator can, without difficulty, connect predetermined wires in the cable to predetermined terminals in the connector which is being installed on the cable.

Figure 4:
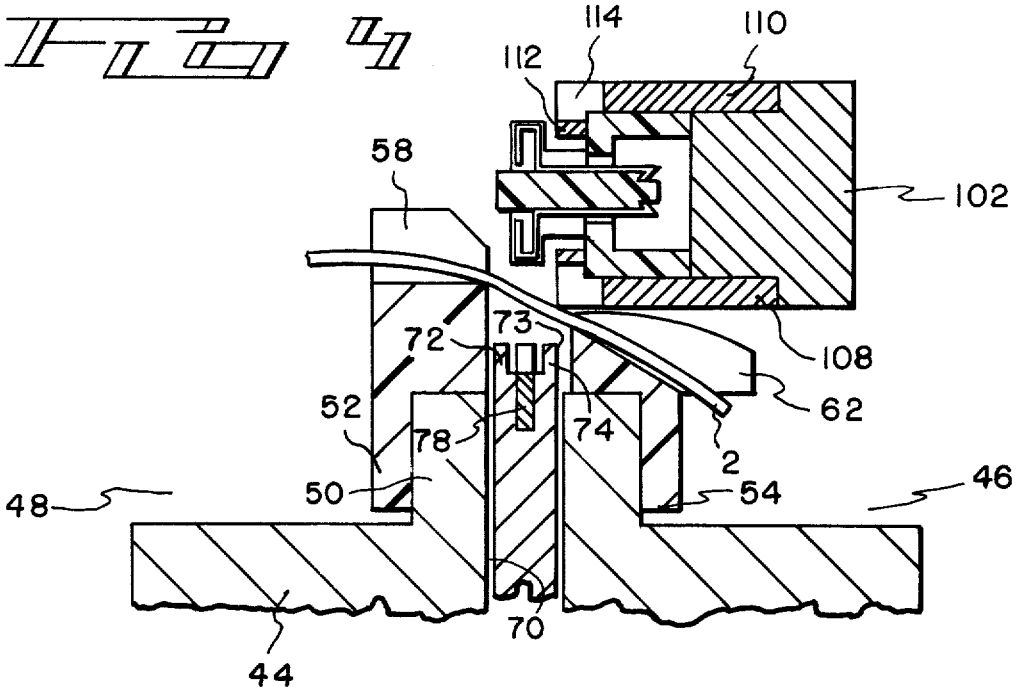
FIG. 4 is a fragmentary view similar to FIG. 3 but showing the connector jig disposed adjacent to the wire jig means, this view showing the positions of the parts immediately prior to insertion of the wires into the terminals in the connector.

In use, the operator first positions the connector jig in a vertical attitude as shown in FIG. 2 and then locates the wires in the cable in the wire combs on each side of the connector jig. Then he swings the connector jig arcuately against one of the connector jig means and locks it in position by means of the locking pin 124. Finally, he swings the appropriate handle downwardly to drive the inserter relatively upwardly thereby to trim the wires and insert the trimmed ends into the terminals as illustrated in FIGS. 4 and 5. Thereafter, he swings the connector jig means against the other conductor jig means and repeats the insertion steps.

When the apparatus is used to attach wires in a cable to the connector, it is desirable to provide a suitable clamp for clamping the cable between the wire jig means and in alignment with the bracket 106. This clamp may be arranged as shown in FIG. 4 of U.S. Pat. No. 3,800,390.

Changes in construction will occur to those skilled in the art and various apparently different modifications and embodiments may be made without departing from the scope of the invention. The matter set forth in the foregoing description and accompanying drawings is offered by way of illustration only.

I claim:

1. Apparatus for inserting wires into the wire-receiving portions of electrical contact terminals which are contained in an electrical connector, said connector being of the type comprising an insulating housing, said wire-receiving portions of said terminals being arranged in first and second rows, said rows extending in parallel spaced-apart relationship to each other, said apparatus comprising:

supporting means having first and second spaced-apart wire jig means thereon, said first wire jig means having means for holding a first predetermined plurality of wires in side-by-side spaced-apart parallel relationship with the distance between adjacent wires being the same as the distance between said adjacent terminals in said first rows, said second wire jig means having means for holding a second plurality of wires in side-by-side spaced-apart relationship with the distance between adjacent wires being the same as the distance between said adjacent terminals in said second row, first and second wire inserting means on said supporting means adjacent to said first and second wire jig means respectively, each of said wire inserting means comprising a plurality of spaced-apart wire insertion punches extending normally with respect to said supporting means, each of said punches being in alignment with a wire disposed in said wire jig means, a connector jig member for holding said connector, said connector jig member being pivotally mounted on an axis which extends mid-way between said first and second wire jig means and parallel to wires disposed in said wire jig means, said connector jig member having means for holding and locating said connector in a position in which said wire-receiving portions of said terminals are brought into alignment with wires in said first and second wire jig means when said connector jig member is moved along arcuate paths against said first and second wire jig means, and actuating means for moving each of said first and second wire inserting means relatively towards said connector jig member along a rectilinear path when said connector jig member is against said first and second wire inserting means respectively whereby, upon locating wires in each of said first and second wire jig means, locating a connector in said connector jig member, moving said connector jig member against said first wire jig means, and then moving said first wire inserting means relatively along said rectilinear path, the wires in said first wire jig means are inserted into said terminals in said first row, and upon moving said connector jig member against said second wire jig means and similarly moving said second wire inserting means relatively along said rectilinear path, the wires in said second wire jig means are inserted into said terminals in said second row.

2. Apparatus as set forth in claim 1 wherein said actuating means for each of said first and second wire-inserting means comprises force multiplying means.

3. Apparatus as set forth in claim 2 wherein each of said force multiplying means comprises a pivotally mounted lever engageable with its respective wire-inserting means.

* * * * *